United States Patent [19]

Putnam, Jr. et al.

[11] 4,136,505

[45] Jan. 30, 1979

[54] TUBELESS VERTICAL FORM, FILL AND SEAL PACKAGING MACHINE WITH IMPROVED FEED MEANS

[75] Inventors: Roger L. Putnam, Jr., East Longmeadow; Richard H. Shultz, Longmeadow; Edward F. O'Brien, Northampton, all of Mass.

[73] Assignee: Package Machinery Company, East Longmeadow, Mass.

[21] Appl. No.: 850,667

[22] Filed: Nov. 11, 1977

[51] Int. Cl.[2] ..... B65B 9/12

[52] U.S. Cl. ..... 53/551

[58] Field of Search ..... 53/177, 180 M, 182 M; 93/82; 156/466

[56] References Cited

U.S. PATENT DOCUMENTS

| | | | |
|---|---|---|---|
| 4,040,237 | 8/1977 | O'Brien | 53/180 M |
| 4,043,098 | 8/1977 | Putnam et al. | 53/180 M |

*Primary Examiner*—Robert Louis Spruill

*Attorney, Agent, or Firm*—McCormick, Paulding & Huber

[57] ABSTRACT

A tubeless vertical form, fill and seal packaging machine has a tube former for receiving flexible packaging material in thin flat strip form and juxtaposing opposite longitudinal edge portions thereof in parallel vertically extending relationship to provide a depending tube open at the top. Side and end sealers respectively seal vertical longitudinal edge portions and provide vertically spaced horizontally extending end seals across the tube. A product dispenser discharges measured quantities of product into the tube interior through its open upper end. Improved tube feed means comprises first and second pairs of vertically spaced rolls respectively on opposite external sides of the tube of packaging material and first and second tube feeding belts respectively trained over said pairs of rolls. Inner runs of the belts engage the tube and have vertically extending imperforate marginal portions and a perforate intermediate portion. Vacuum generating means communicate with the intermediate perforate portions to cause the belts to grip the tube and tube guide and belt back-up means within the tube prevent lateral vacuum loss and provide for frictional tube feeding action. In one form, the back-up means comprise depending cantilevered thin flat members which provide frictional feeding action throughout the width of the belts. In a second form, first and second pairs of back-up members provide frictional feeding action only at the imperforate marginal belt portions. The rolls and belts are adjustable horizontally for varying frictional tube feeding action.

21 Claims, 8 Drawing Figures

TUBELESS VERTICAL FORM, FILL AND SEAL PACKAGING MACHINE WITH IMPROVED FEED MEANS

BACKGROUND OF THE INVENTION

This invention relates generally to machines for forming, filling and sealing packages from an elongated thin flat strip of flexible packaging material, the strip of material being first formed to a depending upwardly open tubular configuration, sealed longitudinally at overlapped vertically extending edge portions, sealed transversely along horizontal lines spaced vertically along the tube, and filled from above with measured quantitites of product between successive transverse or end sealing operations. In advancing or drawing the packaging material downwardly through a tube former at the top of the machine, one conventional practice involves the use of end sealing jaws or bars movable in both horizontal and vertical planes. That is, the end sealing jaws are intermittently moved horizontally inwardly to engage and compress the tube and are then moved vertically downwardly to feed or draw the packaging material through the former. End sealing occurs during the feed operation. Subsequently, the end sealing jaws are moved horizontally outwardly to release the tube and are then returned vertically to their starting position.

Another known practice in advancing or feeding a strip of packaging material through a tube former involves the use of a vacuum feed belt mechanism. A pair of perforate endless belts are disposed respectively on opposite sides of the tube to engage and feed the same downwardly with gripping action provided by a reduced pressure or vacuum condition at openings in the belt. End sealing jaws in this arrangement may be stationary vertically but movable horizontally to intermittently engage, compress and transversely seal the tube between tube feed and product drop or fill operations. German Patent, Auslegeschrift No. 1,586,086, Mar. 23, 1972, discloses a vacuum belt tube feeder in a "tube type" vertical form, fill and seal packaging machine. That is, the machine includes a vertically extending tube within the tube of packaging material which serves to guide a tube of packaging material thereabout and through which measured quantities of product fall in filling the tube of material and packages formed therefrom. U.S. Pat. No. 4,043,098, entitled VERTICAL FORM, FILL AND SEAL PACKAGING MACHINE WITH IMPROVED BACK-UP BAR FOR LONGITUDINAL SEALING, dated Aug. 23, 1977, discloses a vacuum belt mechanism machines in a "tubeless" vertical form, fill and seal machine. In a "tubeless" arrangement, a short vertical tube may be provided within the tube former and the tube packaging material, but the tube terminates at its lower end above the vaccum feed belts. In the region of the feed belts, belt back-up means and side sealing back-up means are provided within the tube of packaging material but are of minimal cross section viewed vertically so as not to interfere with free product fall within the tube of packaging material.

In both of the foregoing arrangements, a relatively long "product drop" is encountered. That is, the distance through which charges of product must fall from the discharge end of the product dispensing means is quite substantial. With the vertically movable end sealer arrangement the necessary vertical or tube feeding travel of the end sealing jaws results in a substantial vertical distance through which the product must fall in the filling operation. Additionally, it will be noted that the portion of the tube immediately above the end sealer is maintained in tension and may be drawn into a relatively sharp or tight "V" configuration during downward movement of the end sealer jaws. Such a tube configuration is not conducive to a good filling operation nor is resulting stress on the tube of packaging material at the end sealing jaws conducive to good end sealing operation.

In the vacuum feed belt arrangement, belt and end sealer operation can be coordinated to provide for a relaxed condition of a tube of packaging material above the end sealer, a relatively loose "V" configuration or a "U" configuration with a slight bulge being provided, and this is conducive to a good filling operation. End sealing may also be efficiently accomplished in the absence of stress on the tube of material during sealing. The inner or operative runs of the vacuum belts, however, must extend through a substantial vertical distance in order to provide sufficient belt-tube contact area for good pure vacuum gripping operation and positive tube feeding action. Thus, some improvement over an end sealer feeding arrangement may be realized but a relatively long product drop is still encountered.

A relatively long product drop distance is generally acceptable for heavy product allowed to fall freely from a product dispensing means in measured quantities into a tube of packaging material. Such is not the case, however with relatively light product such as potato chips and other snack foods. With light product a condition known as product "string out" is encountered wherein air resistance may cause an upper portion of a mass of descending product to decelerate relative to the main body of the mass product. That is, a number of potato chips at the top of a mass of falling chips may tend to "string out" vertically above the main body of the mass as it falls into the tube of packaging material. Obviously, the time required for each filling operation may be significantly increased by product "string out," and this may result in turn in a severe limitation on the overall speed of operation of the machine and production rates will be detrimentally affected.

In addition to the foregoing, a "tubeless" type packaging machine is much to be preferred in handling lightweight product such as potato chips. Jamming of product may obviously occur within the stationary tube of a "tube type" machine. In a "tubeless" machine minimal interference with product fall is achieved with minimal cross sectional area of necessary back-up means within the tube. Further, timing of machine operation may be adjusted to provide for tube feed or downward tube movement assisting at least a portion of the filling operation. That is, without a tube in the feed zone, a mass of potato chips or the like can be engaged peripherally by a downwardly moving tube of packaging material in areas between the back-up means. Thus, a much improved filling operation with lightweight material can be achieved.

From the foregoing, it will be apparent that the efficient high speed handling of potato chips and other lightweight product is best accomplished in a vacuum form, fill and seal machine which is of the "tubeless" type and which provides for a minimum product drop distance.

It is a general object of the present invention to provide a "tubeless" vertical, form, fill and seal packaging machine which has the shortest possible "product drop distance" and which is therefore particularly well-suited to efficient high speed operation in the packaging of relatively lightweight product such as potato chips.

A further object of the invention resides in the provision of a tube feed means which occupies a minimum vertical space in the machine, which yet provides for positive and efficient feeding of a tube of packaging material and which also provides for a relaxed condition of the tube above the end sealer for efficient filling and end sealing.

A still further object of the invention resides in the provision of a packaging machine of the type mentioned wherein a combined vacuum-friction tube feeding action is employed to insure fast positive feeding operation in an extremely short vertical feed zone.

A still further object resides in the provision of a tube feed means of the combined vacuum-friction type wherein provision is made for enhanced vacuum gripping operation in the prevention of lateral vacuum loss between the edge portions of the feed belts and the tube of packaging material.

SUMMARY OF THE INVENTION

In fulfillment of the foregoing objects, a tubeless form, fill and seal packaging machine is provided with improved tube feed means in the form of a vacuum-friction feed means comprising first and second pairs of vertically spaced rolls respectively on opposite external sides of a depending tube of package material. First and second tube feed belts repsectively trained over said first and second pairs of rolls each have a vertically extending inner run engageable with the external surface of the tube of packaging material. Opposite vertically extending marginal portions of each belt are imperforate and an intermediate portion of each belt is perforate for vacuum gripping of the tube. Vacuum generating means communicate with at least the intermediate perforate portion of each belt along its inner run to establish a vacuum hold on the tube of packaging material through the openings in said perforate portions. Tube guide and belt back-up means disposed within the tube of packaging material and in engagement with its internal surface extend vertically opposite at least the imperforate marginal portions of each belt inner run whereby to prevent lateral vacuum loss and to provide for frictional tube feeding action with the inner belt runs externally engaging the tube and driven downwardly. Preferably, the tube guide and belt back-up means provide for frictional tube feeding action throughout the width of the belts but in an alternative embodiment, a spaced pair of back-up members align vertically with and provide frictional tube feeding action only at the opposite imperforate marginal portions of each belt inner run. Drive means rotate at least one roll in each of the first and second pairs of rolls to cause the inner belt runs to travel downwardly in unison and to thereby effect the combined vacuum-friction tube feeding action and positively draw the tube of material downwardly through the tube former.

Postivie gripping and advancement of a tube of packaging material with the improved vacuum-friction feeding action results in a reduction as high as 50 percent (50%) in the length of the inner belt runs, in minimal vertical dimension of the tube feed means, and in the desired short product drop distance. Minimal cross sectional area of the tube guide and back-up means in the tubeless feed zone results in unobstructed product fall within the tube of packaging material and in the maximum possible area of direct contact between peripheral portions of a mass of product and the downwardly moving tube of packaging material. Excellent tube feeding and product filling operation is thus achieved.

Side sealing means associated with the tube feed means is perferably of the continuous or "in transit" type capable of sealing the longitudianlly extending overlapped tube edges as the tube is fed downwardly. The vertical dimension and positioning of the sealing means is such that it does not extend substantially below the feed mechanism or feed zone. Thus, end sealing means may be located beneath and in close proximity to the tube feed zone minimizing product drop distance.

The tube guide and belt back-up means are provided with low fricton surface material for free sliding engagement with the internal surface of the tube of packaging material and the tube feed belts each have a high friction surface for gripping engagement with the external tube surface.

Preferably the tube guide and back-up means are supported at upper end portions and depend in cantilever arrangement from a short tubular product guide means within the tube former but which does not project into the tube feed zone. The members comprising the back-up means have at least minimal spring characterititcs so as to resiliently back-up and react the force of their respective feed belts.

First and second support means provided respectively for the first and second pairs of feed rolls and belts are adapted for precise horizontal adjustment toward and away from the tube of packaging material whereby to vary the pressure exerted by the belts on the material and reacted by the associated back-up means and to thereby adjust frictional tube feeding action and vacuum sealing. Preferably, an elongated screw means interconnects the support means and has oppositely threaded portions for horizontal adjustment of the support means in unison but in opposite directions.

DESCRIPTION OF THE PREFERRED EMBODIMENTS

Figure 1:
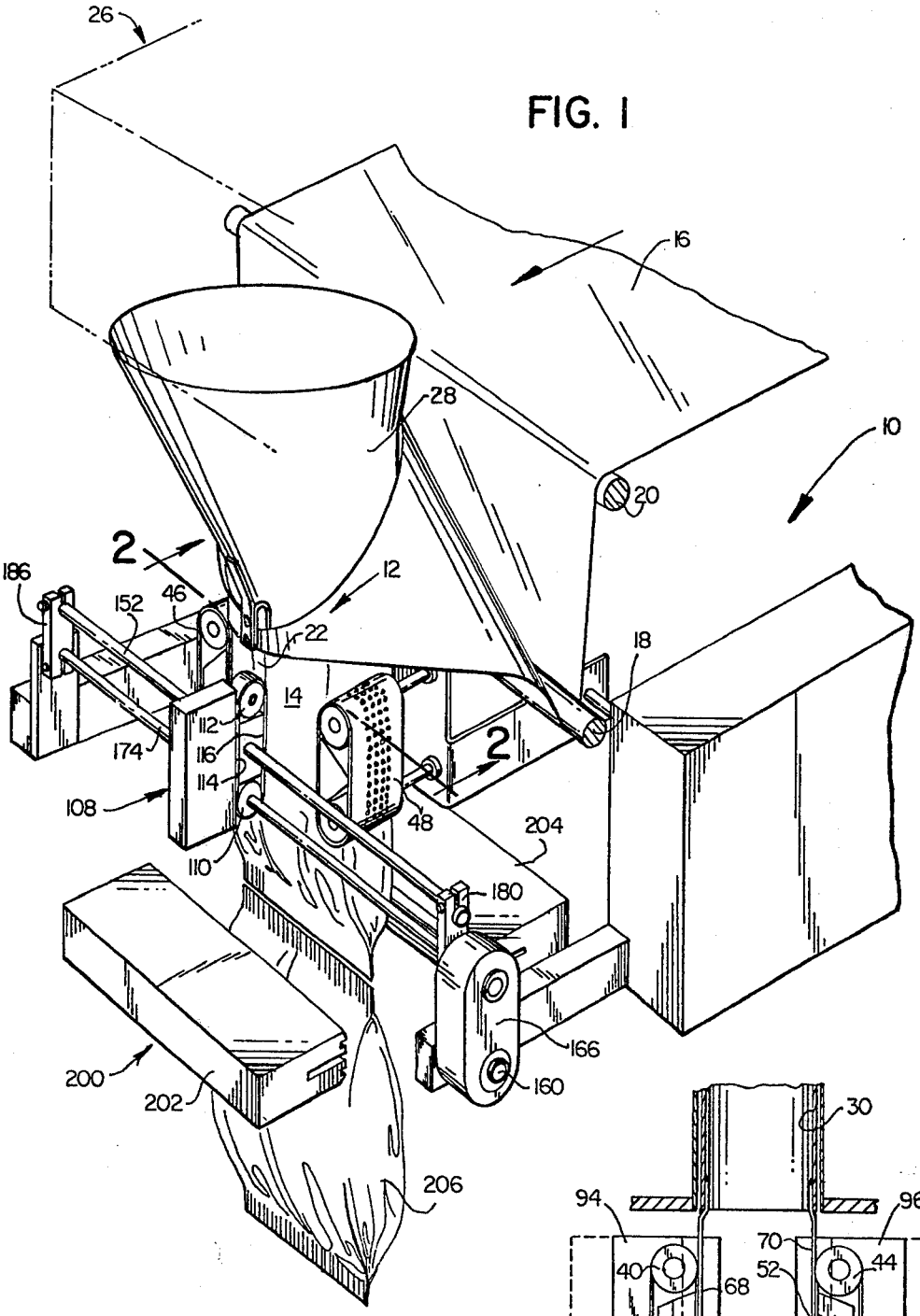
FIG. 1 is a schematic view in perspective illustrating a tubeless form, fill and seal packaging machine constructed in accordance with the present invention.
Figure 3:
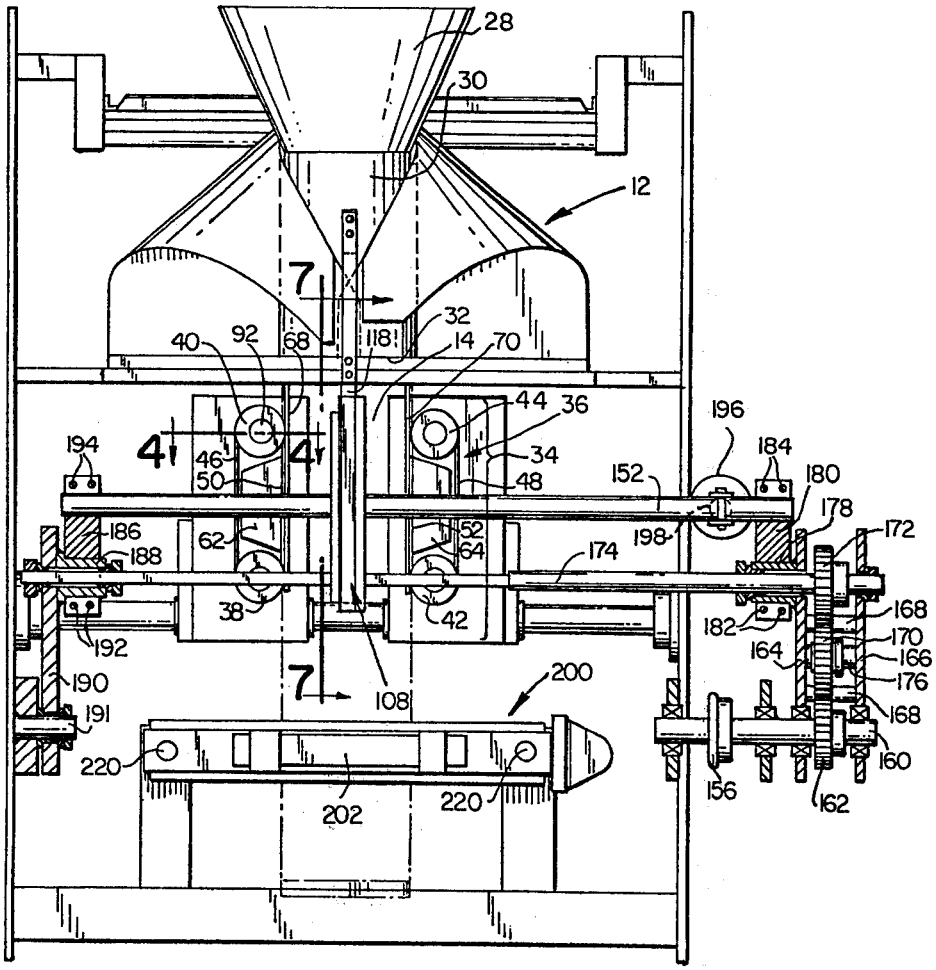
FIG. 3 is a somewhat schematic front elevational view of the packaging machine with portions thereof broken away in section to better illustrate drive means for a side sealing means located at the tube feed zone.
Figure 6:
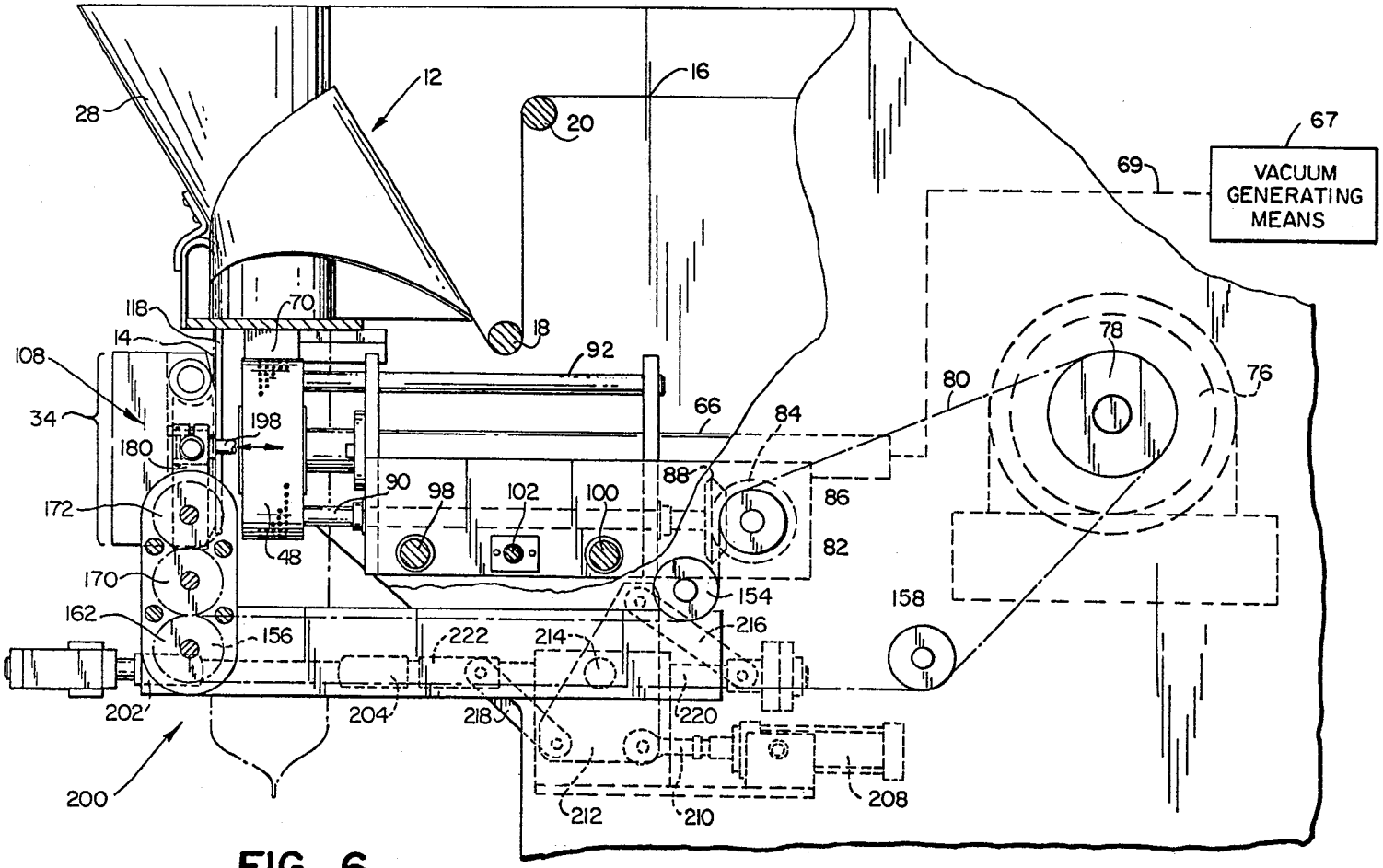
FIG. 6 is a right hand elevational view of the machine of FIGS. 1 and 3 partially broken away to illustrate drive or operating means for the tube feeder, side sealing means, and end sealing means.

Referring particularly to FIGS. 1, 3 and 6, it will be observed that a tubeless form, fill and seal packaging machine indicated generally by the reference numeral 10 includes a tube former or folder indicated generally at 12. Tube formers may be of a square or round type and the former 12 may be of one conventional type adapted to form a generally cylindrical or round tube 14 from flexible packaging material in the form of an elongated, thin, flat strip of material comprising successive package blanks as longitudinally integral contiguous sections thereof. A strip of such material is indicated at 16 in FIGS. 1 and 6 and is guided and directed in its movements from a source of supply toward the tube former 12 guide rolls 18, 20. The source of supply, not shown, may be conventional and may take the form of a pay-off device including a storage roll from which the strip material is drawn. In passage through the former 12 the strip of material is progressively formed to the depending and upwardly open tube 14 shown with opposite longitudinal or vertical edge portions at 22 being juxtaposed by the former in overlapping and parallel vertically extending relationship. Thus, the strip of material 16 becomes a round tube in passage through the tube former, but its edge portions at 22 remain initially in an unsealed condition.

While the tube former shown is of the "round" type with the tube 14 having a generally cylindrical cross section at least initially, it should be noted that the term "tube" is used in a broad sense and is not to be construed as limited to a cylindrical tube or to any other tube of particular cross sectional configuration. Similarly, terminology denoting geometrical or spacial relationship such as "vertical," "horizontal," "depending," "beneath," etc. is employed merely for ease and convenience in description and is not to be regarded as limiting in any sense in the description and claims which follow.

A product dispensing means associated with the packaging machine is indicated generally by reference number 26 and may comprise any of a number of conventional product feeders of the volumetric, weighing or other type. Measured quantities or "charges" of product are dispensed intermittently by the dispensing means for gravity fall into the interior of the tube of packaging material 14 through its upwardly open end. As will be apparent, it is necessary to provide side and end seals to form an upwardly open tubular package for reception of the measured quantity or charges of product from the dispenser 26.

A vertically open tube or tubular product guide means is disposed beneath the product dispensing means for receiving charges of product and for directing the same downwardly to the interior of the tube of packaging material. Said means may comprise a funnel-like element 28 with a lower end portion terminating within the tube former 12 or, said means may comprise a funnel 28 as shown and an integral depending cylindrical tube 30 at a lower end portion of the funnel. The funnel and/or tube extend vertically within the tube former in radially spaced relationship therewith and within the tube of packaging material in the former but in any event the lower end portion of the hopper 28 and/or tube 30 terminate above a tube feed zone in a packaging machine of the "tubeless" type. The tube 30 shown serves both to direct and guide charges of product and to guide the packaging material thereabout and its lower end portion terminates as shown at 32 above a tube feed zone 34 therebeneath.

The improved tube feed means of the present invention at the feed zone 34 comprises first and second pairs of vertically spaced rolls respectively on opposite external sides of the tube of packaging material 14. As shown, the tube feed means is indicated generally at 36 and comprises a first or left hand pair of lower and upper rolls 38, 40, FIGS. 2 and 3. The rolls 38, 40 are spaced vertically along the path of movement of the tube 14 and lower roll 38 is driven with upper roll 40 free running. A second or right hand pair of rolls in FIGS. 2 and 3 comprises driven lower roll 42 and free running upper roll 44. First and second endless feed belts 46, 48 are respectively trained over the first and second pairs of rolls 38, 40 and 42 and each belt has a vertically extending inner run engageable with the external surface of the tube of packaging material 14. Inner run 50 of belt 46 and inner run 52 of belt 48 are so illustrated in FIGS. 2 and 3.

Figure 4:
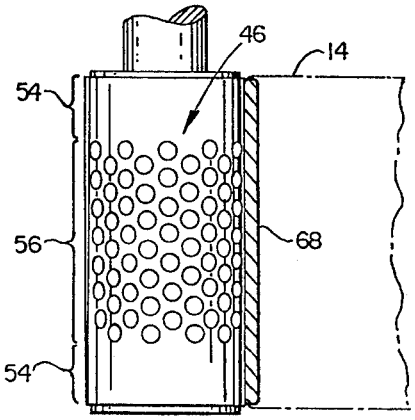
FIG. 4 is an enlarged fragmentary horizontal section taken generally as indicated at 4—4 in FIG. 3 and showing a left hand feed roll, feed belt, an associated tube guide and back-up member, and a portion of a tube of packaging material.
Figure 5:
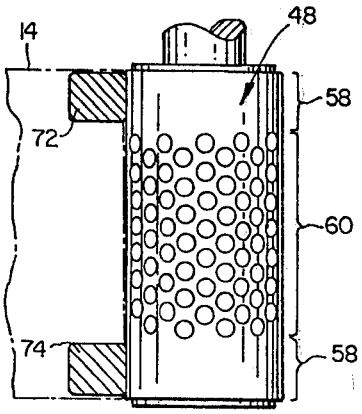
FIG. 5 is an enlarged fragmentary view similar to FIG. 4 but shows a right hand feed roll, feed belt, and a back-up means at an opposite side of a tube of packaging material, the back-up means taking an alternative form with a pair of spaced back-up members opposing imperforate marginal belt portions.

As best illustrated in FIGS. 4 and 5, the feed belts 46 and 48 each have vertically extending opposite marginal portions which are imperforate and an intermediate portion which is perforate. The belt 46 is shown in FIG. 4 with imperforate opposite marginal portions 54, 54 and a perforate imtermediate portion 56 while the belt 48 in FIG. 5 has imperforate marginal portions 58, 58 and intermediate perforate portion 60. Vacuum generating means communicate with at least the intermediate perforate portions of the belts along their inner runs 50, 52 whereby to cause the belt runs to grip the tube packaging material for downward feeding or advancement thereof on downward movement of the belt runs. As shown, the belt 46 has an associated vacuum box 62, FIGS. 2 and 3, and the belt 48 has a similar vacuum box 64 associated therewith, the said vacuum boxes being disposed between inner and outer belt runs. The vacuum boxes 62, 64 in turn communicate with a vacuum tube 66 best illustrated in FIG. 6 and which extends rearwardly in the packaging machine for communication with a conventional vaccum generating means 67 via broken line 69.

In order to provide the combined vacuum-friction feeding action of the tube feed means of the present invention, a tube guide and belt back-up means is disposed within the tube of packaging material 14 in engagement with its internal surface and said means extends vertically opposite at least each imperforate marginal portion of each belt inner run to prevent lateral vacuum loss and to provide for frictional tube feeding action. That is, a slight pressure engagement of the vacuum belt inner runs with the tube of packaging material is established and reacted by the tube guide and belt back-up. A vacuum sealing effect is thus achieved between the tube of packaging material and the imperforate marginal belt portions 54, 54 and 58, 58 whereby to prevent lateral vacuum loss from the lateral ingress of ambient air between the belts and the packaging material. Thus, positive gripping action of the tube of material and vacuum feeding is enhanced. Further, the desired frictional feeding action is provided to assist the vacuum feeding action of the belt inner runs.

Figure 2:
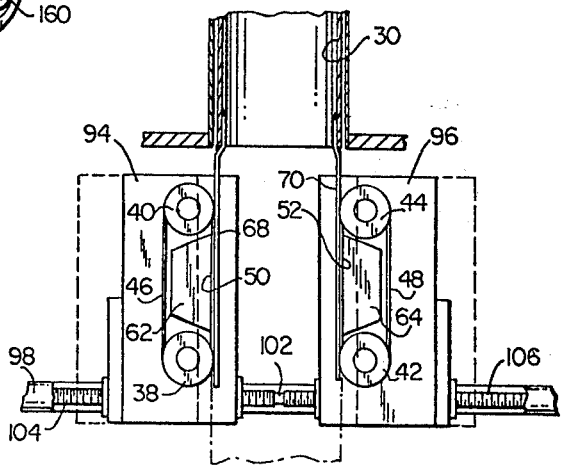
FIG. 2 is a somewhat schematic and fragmentary vertical section taken through a tube feed zone as indicated generally at 2—2 in FIG. 1.

The presently preferred tube guide and belt back-up means comprises first and second elongated vertically extending thin flat members 68, 70 shown in FIGS. 2 and 3 respectively disposed in opposing relationship with the inner runs 50, 52 of the feed belts 46, 48. First oapproximately equal to the width of the belt 46 so as to First or left hand back-up member 68 is better illustrated in section in FIG. 4 and it will be observed that its width is approximately equal to the width of the belt 46 so as to provide frictional belt feeding action throughout the width of the belt. Back-up member 70 is identical in construction and in its cooperation with the belt 48. As best illustrated in FIG. 2, the back-up members 68, 70 are secured at upper end portions to the tube 30 of the tubular product guide means and depend therefrom, in cantilever relationship within the tube of packaging material. The back-up members have at least minimal spring characteristics so as to resiliently back up their respective tube feeding belts and to assist in the necessary slight pressure engagement between the belts and the tube of packaging material.

Referring now to FIG. 5, alternative tube guide and back-up means comprises first and second pairs of elongated vertically extending flat faced members disposed internally of the tube of packaging material and respectively in opposing relationship with the opposite marginal portions of the first and second feed belts. A second or right hand pair of back-up members is illustrated in FIG. 5 at 72, 74 in operative association with the belt 48 and, more particularly, the opposite imperforate marginal portions 58, 58 of the belt. As illustrated, the width of the right hand or flat faces of the members 72, 74 is approximately equal to the width of the imperforate belt portions 58, 58. The members 72, 74 and their counterparts in a left hand pair adjacent a left hand belt may be arranged in depending cantilever fashion with upper ends secured to a tube such as the aforementioned tube 30.

Comparing FIGS. 4 and 5 it will be observed that the member 68 has the advantage of maximum frictional feeding action in its engagement throughout the width of the belt 46 whereas a slightly less efficient frictional feed results with the back-up member 72, 74, frictional feed occurring only at the opposite marginal belt portion 58, 58. Conversely, the free area of the tube of packaging material 14 exposed to potato chips or other lightweight product and moving downwardly to inhibit jamming of the product is somewhat greater in the FIG. 5 arrangement than in the FIG. 4 arrangement.

The width of the impreforate marginal belt portions 54, 54 and 58, 58 may vary but it is believed that each such portion should comprise at least 10 percent of total belt width. As illustrated, each marginal portion 54, 58 comprises approximately 20 to 25 percent of total width of its belt and excellent results are achieved. That is, vacuum sealing action is highly effective with the ingress of ambient air between belt marginal portions and the tube 14 minimize and positive frictional feeding action is achieved. With the FIG. 4 arrangement, frictional feed also results at the perforate belt portion 56 and it is believed that this belt portion should have open vacuum area in the range 20 to 60 percent of the total area of the belt portion. As illustrated, the intermediate belt portion 56 is approximately 40 percent open or vacuum area and excellent results have been obtained.

Belt material may also vary but should have high friction characteristics for efficient feeding action. A rubber-like material is preferred and at present a silicone rubber is employed. The back-up means, on the other hand, should have a low friction surface for free sliding engagement with the internal surface of the tube of packaging material 14. A fiberglass facing covered with a fluorocarbon polymer is presently preferred and a Teflon covering employed.

A comparison of vacuum-friction feeding action with a pure vacuum feeding action as in the above-mentioned U.S. Pat. No. 4,043,098 may now be noted. Good feeding action is obtained with the patented arrangement with belt feed rolls arranged on 12 inch centers and with the belts drawing the tube of material laterally away from internal back-up members for pure vacuum feeding. With the present arrangement belt rolls are arranged on six inch centers, roll axes spaced apart six inches vertically, and excellent vacuum-friction feeding action has been obtained. This, a 50 percent reduction in length of the feed zone has been achieved and the salutory effect on product drop distance will be self evident.

The manner in which the lower feed rolls 38, 42 are driven may vary widely and an illustrative example is shown schematically in FIG. 6. A motor, variable speed driven, and clutchbrake mechanism is illustrated at 76 with an output sprocket 78 driving a chain 80 extending to a drive sproket 82 for a bevel gear 84. The bevel gear 84 is mounted on a shaft 86 which carries a similar bevel gear at an opposite side of the machine, not shown. The bevel gear 84 drives the lower roll 42 and the opposite bevel gear drives the roll 38 in unison therewith and in the appropriate direction for downward movement of inner belt runs 50, 52. A bevel gear 88 is driven by the bevel gear 84 to rotate a shaft 90 which in turn supports and drives the roll 42. A similar arrangement is provided at the opposite side of the machine for the roll 38. Upper roll 44 is free running and supported on a shaft 92 in FIG. 6, a similar shaft being provided for the roll 40 at 92, FIG. 3.

Referring now particularly to FIG. 2 it will be observed that first and second support means are provided respectively for the feed rolls and belts of the tube feed means 36. A support means 94 for the first or left hand pair of feed rolls 38, 40 journals the aforementioned roll carrying shafts and a support means 96 for the right hand rolls 42, 44 is similarly constructed and arranged. The support means 94, 96 are slidably mounted on cross bars 98, 100, FIG. 6, so as to provide for horizontal movement of the support means and the left hand and right hand roll and belt assemblies toward and away from a tube of packaging material 14. Thus, horizontal adjustment may be accomplished for varying the pressure exerted by the feed belts 46, 48 on the tube of material and reacted by the associated back-up means 68, 70. Frictional tube feeding action is thus manually adjustable. Preferably, adjustment of the support means 94, 96 and the roll and belt assemblies is accomplished in unison and in opposite directions as required by means of an elongated screw means 102, FIGS. 2–6, which is threadably engaged with each of the support means and which has oppositely threaded portions 104, 106. On rotating the screw means or screw 102 to the desired positon of adjustment, provision may of course be made for locking the support means, 94, 96 and the roll and belt assemblies in position.

With the belt pressure on the tube 14 properly adjusted for the desired frictional feed, it will be apparent that the belts can be driven intermittently as required for tube feed operations in timed relationship with sealing and filling operations. The clutch-brake mechanism in the drive assembly 76 can be energized and de-energized as required by appropriate electrical control means whereby to drive the above described power train and the roll and belt assemblies. Co-pending application Ser. No. 846,820 entitled IMPROVED CONTROL SYSTEM FOR PACKAGE MAKING MACHINE, Charles J. Simmons, Filed on Oct. 31, 1977 illustrates and described a suitable electrical control system for this purpose.

The packaging machine also includes side sealing means for sealing the depending longitudinal edges of the tube of packaging material 14. Such sealing means is indicated generally at 108 in FIGS. 1, 3 and 6 and is of the continuous or "in transit" type adapted to seal the longitudinal tube edges at 22 as the tube of material 14 is drawn downwardly through the former by the tube feed means 36. As shown, the side sealer 108 is disposed between the tube feeding rolls and belts with the latter arranged on opposite external sides of the tube packaging material with the longitudinal edge portions of the tube displaced approximately 90°from each of the pairs of rolls and belts. Further, the position and vertical dimension of the side sealer 108 is such that its lower end does not extend substantially below the feed rolls and belts and thus permits the location of an end sealing means closely therebeneath with resulting minimization of product drop.

The side sealer 108 is preferably of the hot belt type and includes a third vertically spaced pair of rolls with a lower driven roll shown at 110 and an upper free running roll at 112. The rolls 110, 112 have an endless belt 114 trained thereover with an inner run 116 extending vertically and engageable with the longitudinally extending tube portions at 22. Extending internally of the tube is a sealing back-up member 118 which engages the longitudinal tube edges and serves to react force of the sealing belt 114. The back-up member is preferably secured at an upper end portion to the funnel 28 as illustrated so as to depend in cantilever relationship and to resiliently back-up the sealing belt. In accordance with the free product fall and tube engagement requirements of a tubeless machine, the member 118 is constructed with a minimal cross section viewed vertically and is preferably provided with a low friction surface for sliding engagement of the tube 14 thereover. A fluorocarbon polymer is preferred and, more specifically, a Teflon cover layer on a sponge-like fiberglass tape underlayer is presently employed. The tape may also serve an insulating function to prevent excessive heat conduction to the cold back-up member from the hot belt 114 of the sealer.

The hot belt 114 is preferably also adapted for friction tube feeding action and, accordingly, is provided with a high friction surface. A heat resistant rubber-like material is perferred and a silicone rubber is presently employed with heat resistance to approximately 550°F. The reverse side of the belt may be of a two ply monofilament polyester for engagement with the rolls 110, 114.

At this point a comparison should be made between the hot belt side sealer 108 and prior art drag sealers and long bar sealers. Drag type sealers tend to inhibit downward tube feed movement rather than to provide a frictional feed assist. Long bar sealers, on the other hand, operate intermittently to engage and seal the longitudinal edges of a tube of packaging material and while they do not inhibit tube feeding operation, they do create a necessary long product drop condition especially in the case of relatively long packages.

Figure 7:
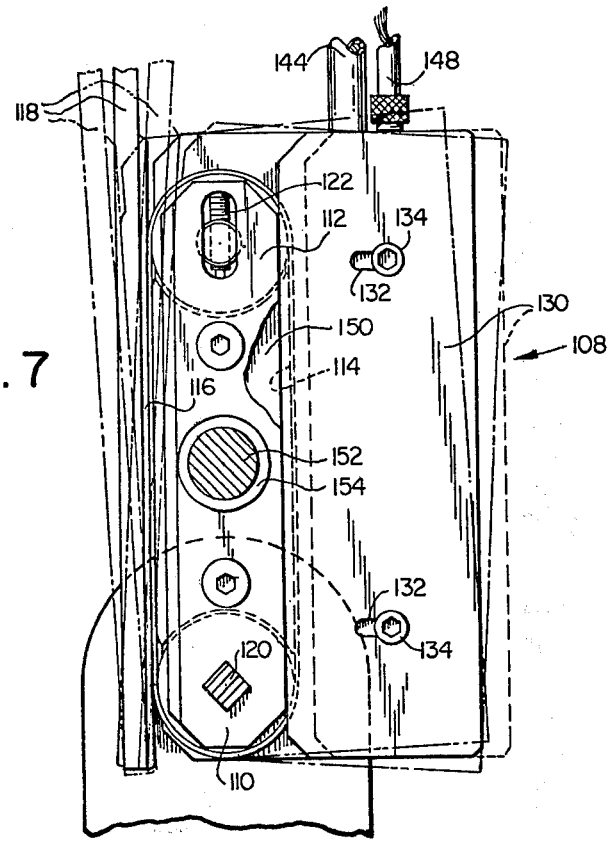
FIG. 7 is an enlarged fragmentary view taken generally as indicated at 7—7 in FIG. 3 and showing a side sealing means.
Figure 8:
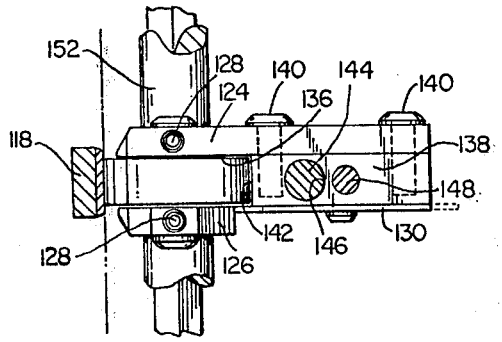
FIG. 8 is a top view of the side sealing means of FIG. 7.

Referring particularly to FIGS. 7 and 8, the detailed construction of the hot belt side sealer 108 will be better understood. Driven roll 110 is mounted on a rectangular shaft 120 which extends horizontally in the packaging machine and free running roll 112 has a short stub shaft 122 journalled in a housing comprising spaced vertically extending plates 124, 126, FIG. 8. The plates 124, 126 are slotted vetically to provide for adjustment of the stub shaft 122 by means of adjustment screws 128, 128. Thus, the belt 114 may be trained over the rolls 110, 112 and the roll 112 adjusted vetically for proper belt tensioning. In introducing the belt 114 to the rolls 110, 112, the belt may be moved axially thereover from a lower axial position in FIG. 8 with a belt retaining plate 130 displaced rightwardly in FIGS. 7 and 8 to accommodate belt entry. Horizontal slots 132, 132 in the plate 130 cooperate with small binder screws 134, 134 to allow the plate 130 to be moved rightwardly for belt entry and thereafter moved leftwardly and secured in position for belt retention. When in position on the rolls 110, 112 the belt 114 resides in a belt channel 136 defined between the plates 124, 126, FIG. 8.

Heating means for the belt 114 preferably takes the form of a heat block 138 secured to the housing plate 124 by suitable screws 140, 140 and disposed between said plate and the plate 130. The heat block 138 had good heat conduction characteristics, as for example a steel block, and has a vertically extending inner surface 142 which engages a rear or outer run of the belt 114 in heat transfer relationship therewith. A heating element. preferably electrical, 114 is entered in a suitable vertical opening 146 in the heat block 138 and heat sensing element 148 is disposed adjacent thereto. Conventional electrical power and control means, not shown, are connected with heating element 114 and the heat sensor 148 to maintain the heat block 138 at the desired temperature for efficient sealing by the belt inner run 116 at the longitudinal tube edges. A temperature in the neighborhood of 200° F is presently employed for the heat block 138.

Disposed between the inner and outer runs of the belt 114 and best illustrated at broken away portion, FIG. 7, is a heat bar 150. The bar 150 is secured in position between the plates 124, 126 and has inner and outer surfaces which extend vertically and which respectively engage the inner and outer belt runs. The bar 150 should be of a good heat conductor and steel is presently employed.

In operation, the heat block 138, the heat bar 150 and the belt 114 are maintained at desired heat sealing temperature as indicated and preferably insulation is provided at least about the rear portion of the sealer and around the plate 124, the heat block 138 and the plate 130. Further, a support rod 152 extends through the plates 124, 126 and the heat bar 150 and a heat insulating bushing 154 is preferably provided about the rod. Heat loss to the rod 152 is thus minimized, a bushing 154 of ceramic material being presently employed. Still further, the sealing back-up bar or member 118 may be provided with a source of heat to prevent excessive heat loss thereto through the longitudinal edges of the tube of packaging material. At the present time, however, insulation of the back-up bar is deemed sufficient.

The hot belt sealer 108 is driven in unison with the tube feeder 36 and as best illustrated in FIG. 6, the aforementioned chain 80 extends from the sprocket 82 to an idler sprocket 154. From the sprocket 154 the chain extends forwardly in the machine to drive a sprocket 156, FIGS. 3 and 6. From the sprocket 156 the chain extends to a second idler sprocket 158 and returns to the main drive sprocket 78 from the motor, variable speed drive, and brake-clutch mechanism.

As best illustrated in FIG. 3, the sprocket 156 is mounted on a short shaft 160 which also carries a first or lowermost gear 162 in a three gear train mounted between plates 164 and 166. The plates 164 and 166 are secured together by short tie rods 168, 168. A second or intermediate gear 170 in the train drives an uppermost or third gear 172 mounted on a cylindrical extension 174 of the rectangular drive shaft 120 for the lower sealing belt roll 110. Each of the shafts 160 and 174 is journalled in the plates 164, 166 and intermediate gear 170 has a short stub shaft 176 also journalled in the plated 164, 166.

Still referring to FIG. 3, the plate 164 has a short cylindrical housing or annular boss 178 through which the shaft 174 extends and about which a lower end portion of a pivot bar 180 is secured. That is, the pivot bar 180 has a split lower end portion with a pair of binder screws 182, 182 and the bar may thus be secured in position about the boss 178 at selected angles of inclination from the vertical. At an upper end portion the pivot bar 180 also has a bifurcated or split configuration and is provided with a pair of binder screws 184, 184. The split upper end portion of the pivot bar receives a right hand end portion of the mounting rod 152 for the heat sealer 108 and is adjustable with respect thereto on suitable manipulation of the binder screws.

At the left hand side of the machine and an opposite end portion of the rod 152, a second pivot bar 186 is provided and may be identical in all respects with the pivot bar 180. A split upper end portion thereof adjustably receives the mounting rod 152 and a split lower end portion thereof receives a cylindrical extension or annular boss 188 on a plate 190. The boss 188 is concentric with and receives a left hand end portion of the drive shaft 120 for the lower roll 110 of the side sealer. Binder screws 192, 192 are associated with split lower end portion of the pivot bar 186 and binder screws 194, 194 are provided at an upper end portion thereof.

From the foregoing, it will be apparent that the side sealer 108 can be adjusted toward and away from the longitudinal edge portions of a tube of packaging material 14 and its back-up member 118. Such adjustment is illustrated in somewhat exaggerated form by broken line positions of the side sealer and the back-up member 118 in FIG. 7. Both efficient side sealing and the desired frictional tube feeding assist are insured with proper adjustment of the side sealer. In effecting such adjustment, binder screws at the lower and/or upper ends of the pivot bars 180, 186 are first loosened the pivot bars are then swung arcuately as necessary to provide for the desired pressure engagement of the inner belt run 116 with the tube edges and back-up member 118. The binder screws are then re-tightened to secure the pivot bars and the side sealer 108 in position. Thereafter, the side sealer belt 114 is operated in unison with the tube feeder 36 by the aforementioned drive means.

It may also be desirable or necessary to move the side sealer 108 completely away from the longitudinal edge portions of the tube 14 as for example on termination of packaging machine operation for a significant period of time. Deterioration or destruction of the packaging material from an overheat condition might otherwise occur. In accomplishing side sealer withdrawal, a presently preferred practice involves provision of a fluid cylinder 196 mounted on the machine frame as illustrated in FIG. 3. The cylinder has a reciproable rod 198 shown in broken line in FIG. 3 and partially illustrated in FIG. 6. A forward end portion of the rod is secured to the mounting rod 152 for the side sealer for movement of the rod on actuation of the fluid cylinder. When it is desired to withdraw the side sealer from engagement with the tube packaging material, the rod 198 is moved leftwardly in FIG. 6 whereupon the entire assembly comprising the rod, side sealer 108, the gears 162, 170 and 172 and the plates 164, 166 are swung arcuately in a counterclockwise direction about the center of shaft 160. Slight displacement of the gear 170 relative to the gear 162 may occur during such swinging movement but has no detrimental effect. On resumption of machine operation, or a ready condition, the fluid cylinder 196 may be actuated to move the rod 198 rightwardly in FIG. 6 and return the side sealer 108 to its operative position as illustrated.

End sealing means in the packaging machine of the present invention are preferably of the vertically stationary type as indicated above and appear schematically in FIG. 1 and in somewhat more detail in FIGS. 3 and 6. The reference numeral 200 is used to indicate the end sealing means generally and said means may be of a conventional type illustrated and described more fully in U.S. Pat. No. 4,040,237 entitled SEALING JAW MECHANISM FOR PACKAGE MAKING MACHINE, Edward F. O'Brien, issued on Aug. 9, 1977. A pair of sealing bars or jaws is provided as indicated at 202, 204 and the jaws or bars are adapted to be moved toward each other in unison to compress and seal a tube of packaging material transversely. Electrical or mechanical cut-off means may also be included in the jaws 202, 204 to sever a completed package of material such as the package 206 in FIG. 1. The jaws are operated intermittently in timed relationship with the tube feeder and side sealer but their operating means is independent of the drive means for the tube feeder and side sealer so as to accommodate independent timing adjustment and to form packages or bags 206 of varying length. That is, a relatively short tube feeding and side sealing operation may be provided followed by a timed end sealing operation for relatively short bags and a relatively long tube feeding and side sealing operation followed by a timed end sealing operation for longer bags. The packaging machine of the present invention may be adjusted in its timed operation to provide bags ranging from four to five inches in length to 18 to 20 inches in length. Further description and illustration in this regard appears in the aforementioned copending application Ser. No. 846,820 entitled IMPROVED CONTROL SYSTEM FOR PACKAGE MACKING MACHINE, Charles J. Simmons, Filed on Oct. 31, 1977.

The independent drive or operating means for the end sealer 200 preferably comprises a fluid cylinder 208 shown in broken line form in FIG. 6. The cylinder 208 is electrically controlled and has an output rod 210 extending to a toggle member 212. The toggle member 212 swings about a pivot point 214 and has a rear toggle link 216 and a front toggle link 218. The rear toggle link 216 is attached to rod or rods 220 which extends forwardly in the machine to the front sealing jaw 202. The rear sealing jaw 204 is driven by a slide member 222 in turn driven by the front toggle link 218.

It will be apparent that left hand or forward movement of the cylinder rod 210 will pivot the toggle member 212 in a clockwise direction about its pivot point 214 whereby to cause the toggle link 216 to urge the rod 220 rightwardly or rearwardly in the machine and to draw the jaw 202 rearwardly and into engagement with a tube of packaging material. Simultaneously, the toggle link 214 urges the slide member 222 and the jaw 204 forwardly or in a left hand direction to cooperatively engage, compress, and seal the tube of packaging material. Release of the tube of packaging material by the jaws 202, 204 is of course accomplished on a return stroke of the rod 210 and operation of the aforesaid elements in an opposite direction.

The elements shown in broken line in FIG. 6 may of course be duplicated at an opposite side of the machine and at an opposite end of the sealing jaws 202, 204.

From the foregoing it will be apparent that the improved packaging machine of the present invention embodies a judicious combination of all features desirable in the efficient handling of lightweight product in high speed packaging machine operation. The tubeless construction of the machine together with its short product drop characteristics provides for substantial improvement in product handling and speed of operation. Machine speed is substantially enhanced and it is believed that a 100 percent improvement in production rates can be achieved. Whereas prior machines have operated in the range of 30 to 40 packages or bags per minute, the present machine has been successfully operated in the range of 90 to 100 package per minute.

We claim:

1. A tubeless vertical form, fill and seal packaging machine comprising a source of flexible packaging material in the form of an elongated thin flat strip of material of uniform width comprising successive flat package blanks as integral longitudinally contiguous sections thereof, a tube former adapted to receive said strip material and to progressively form the same to a depending and upwardly open tubular configuration, opposite longitudinal edge portions of the material being progressively juxtaposed by said former so as to extend vertically in parallel relationship for side sealing, product dispensing means above said former and operable for the gravity discharge of measured quantities of product, vertically open tubular product guide means beneath said product dispensing means for receiving said measured quantities of product and for directing the same downwardly to the interior of the tube of packaging material through its said upwardly open end, said means extending vertically within said tube former in radially spaced relationship therewith and within the tube of packaging material formed therein, side and end sealing means disposed beneath said tube former and guide means respectively for sealing said vertically extending longitudinal edge portions of the tube and for providing successive longitudinally spaced horizontal end seals across the tube, first and second pairs of vertically spaced rolls respectively on opposite external sides of said tube of packaging material beneath said product guide mean, first and second tube feeding belts respectively trained over said first and second pairs of rolls, each belt having a vertically extending inner run engageable with the external surface of the tube of packaging material, and opposite vertically extending marginal portions of each belt being imperforate and an intermediate portion thereof perforate, vacuum generating means communicating with at least said intermediate perforate portions of each of said belts along their said inner runs to cause the belts to grip the tube of packaging material with the inner belt runs in engagement therewith, tube guide and belt back-up means disposed within the tube of packaging material in engagement with its internal surface and extending vertically opposite at least each imperforate marginal portion of each belt inner run whereby to prevent lateral vacuum loss and to provide for frictional tube feeding action with the inner belt runs externally engaging the tube, and means for driving at least one roll in each of said first and second pairs of rolls to cause said inner belt runs to travel downwardly in unison and thereby to effect combined vacuum-friction tube feeding action positively drawing the tube of material downwardly through the former and successively presenting said integral package blanks therebeneath in tubular form for filling, sealing and package formation.

2. A tubeless vertical form, fill and seal packaging machine as set forth in claim 1 wherein said first and second pairs of tube feeding rolls and their belts are arranged on opposite external sides of said tube of packaging material with the longitudinal edge portions of the tube displaced approximately 90° from each said pairs of rolls and belts, and wherein said side sealing means is arranged therebetween and adjacent said tube edge portions so as to engage and seal the same, the position and vertical dimension of said sealing means being such that its lower end does not extend substantially below said rolls and belts thus permitting location of said end sealing means closely therebeneath and minimizing the vertical distance through which the quantities of product must fall.

3. A tubeless vertical form fill and seal packaging machine as set forth in claim 2 wherein said side sealing means is adapted to engage and to seal together said longitudinal tube edges in transit and as the tube of material is drawn downwardly through the former by said tube feeding rolls and belts.

4. A tubeless vertical form, fill and seal packaging machine as set forth in claim 3 wherein said side sealing means is maintained in external pressure engagement with said longitudinal tube edge portions, and wherein a sealing back-up member is disposed within said tube of packaging material and extends vertically adjacent and engages internally said longitudinal edges whereby to react the force of said sealing means.

5. A tubeless vertical form, fill and seal packaging machine as set forth in claim 4 wherein said tube guide and belt back-up means and said sealing back-up member are each of minimal cross section viewed vertically so as not to interfere with free product fall within the tube of packaging material.

6. A tubeless vertical form, fill and seal packaging machine as set forth in claim 5 wherein said tube guide and belt back-up means and said sealing back-up member are each provided with a low friction surface material for free sliding engagement with the internal surface of the tube of packaging material.

7. A tubeless vertical form, fill and seal packaging machine as set forth in claim 5 wherein said end sealing means comprises a pair of opposing sealing jaws beneath said tube feeding rolls and belts and movable horizontally in unison toward and away from said tube of packaging material respectively to engage and end seal the tube and to free the tube.

8. A tubeless vertical form, fill and seal packaging machine as set forth in claim 7 wherein said end sealing jaws are adapted for operation independently of but in timed relationship with said tube feeding belts whereby to form packages of varying length from said tube of packaging material.

9. A tubeless vertical form, fill and seal packaging machine as set forth in claim 1 wherein said tube guide and belt back-up means comprises first and second elongated vertically extending thin flat members respectively disposed internally of the tube of packaging material in opposing relationship with said first and second tube feeding belts, each of said back-up members having a width approximately equal to the width of its associated belt so as to provide frictional feeding action throughout the width of each belt.

10. A tubeless vertical form, fill and seal packaging machine as set forth in claim 9 wherein said back-up members are secured at upper end portions to said tubular product guide means and depend therefrom in cantilever relationship within the tube of packaging material, said members having at least minimal spring characteristics so as to resiliently back up and react the force of their respective tube feeding belts.

11. A tubeless vertical form, fill and seal packaging machine as set forth in claim 10 wherein said tube guide and belt back-up members have a low friction surface for free sliding engagement with the internal surface of the tube of packaging material, and wherein said tube feeding belts each have a high friction surface for gripping engagement with the external tube surface.

12. A tubeless vertical form, fill and seal packaging machine as set forth in claim 11 wherein said back-up member surfaces are of a fluorocarbon polymer, and wherein said belt surfaces are of a rubber-like material.

13. A tubeless vertical form, fill and seal packaging machine as set forth in claim 1 wherein said tube guide and back-up means comprises first and second pairs of elongated vertically extending flat faced members disposed internally of the tube of packaging material respectively in opposing relationship with said first and second tube feed belts, the back-up members of each pair being spaced apart horizontally so that their said flat faces respectively oppose the opposite imperforate marginal portions of the associated feed belt, and the width of said flat faces being approximately equal to the width of said marginal belt portions for frictional feeding action throughout the width of said marginal portions.

14. A tubeless vertical form, fill and seal packaging machine as set forth in claim 3 wherein said back-up members are secured at upper end portions to said tubular product guide means and depend therefrom in cantilever relationship within the tube of packaging material, said members having at least minimal spring characteristics so as to resiliently back-up said tube feeding belts.

15. A tubeless vertical form, fill and seal packaging machine as set forth in claim 14 wherein said tube guide and belt back-up members have a low friction surface for free sliding engagement with the internal surface of the tube of packaging material, and wherein said tube feeding belts each have a high friction surface for gripping engagement with the external tube surface.

16. A tubeless vertical form, fill and seal packaging machine as set forth in claim 15 wherein said back-up member surfaces are of a fluorocarbon polymer, and wherein said belt surfaces are of a rubber-like material.

17. A tubeless vertical form, fill and seal packaging machine as set forth in claim 1 wherein each of said imperforate marginal portions of each feed belt comprises at least 10% of total belt width.

18. A tubeless vertical form, fill and seal packaging machine as set forth in claim 17 wherein each of said imperforate marginal portions of each feed belt comprises approximately 20 to 25% of total belt width.

19. A tubeless vertical form, fill and seal packaging machine as set forth in claim 17 wherein said perforate portion of each feed belt has open vacuum area in the range of 20 to 60% of total area of the perforate portion.

20. A tubeless vertical form, fill and seal packaging machine as set forth in claim 1 wherein said tube feed belts and support rolls are mounted for horizontal adjustment toward and away from the tube of packaging material for varying pressure exerted by the belts on the material and reacted by the associated back-up means and for thereby adjusting frictional tube feed action.

21. A tubeless vertical form, fill and seal packaging machine as set forth in claim 20 wherein first and second support means are provided respectively for said first and second pairs of feed rolls and belts and are interconnected by elongated screw means having oppositely threaded portions for horizontal adjustment in unison and in opposite directions for the support means and their roll and belt assemblies on manual manipulation of the screw means.

* * * * *

UNITED STATES PATENT OFFICE

CERTIFICATE OF CORRECTION

Patent No. 4,136,505 Dated January 30, 1979

Inventor(s) Roger L. Putnam, Jr., Richard H. Shultz, and Edward F. O'Brien

It is certified that error appears in the above-identified patent and that said Letters Patent are hereby corrected as shown below:

Column 1, line 15, "quantitites" should be --quantities--.

Column 1, line 52, "vacuum belt mechanism machines" should be --vacuum belt feed mechanism--.

Column 1, line 55, after "tube" (second occurence) insert --of--.

Column 3, line 31, "repsectively" should be --respectively--.

Column 3, line 61 "Postivie" should be --Positive--.

Column 4, line 28 "characterititcs" should be --characteristics--.

UNITED STATES PATENT OFFICE

CERTIFICATE OF CORRECTION

Patent No. 4,136,505 Dated January 30, 1979

Inventor(s) Roger L. Putnam, Jr., et al

It is certified that error appears in the above-identified patent and that said Letters Patent are hereby corrected as shown below:

Column 5, line 21, "movements" should be --movement--.

Column 5, line 22, after "12" insert --by--.

Column 6, line 22, after "42" insert --44--.

Column 6, line 38, after "tube" insert --of--.

Column 6, line 47, "vaccum" should be --vacuum--.

Column 7, lines 5 and 6, delete "First oapproximately equal to the width of the belt 46 so as to".

UNITED STATES PATENT OFFICE

CERTIFICATE OF CORRECTION

Patent No. 4,136,505 Dated January 30, 1979

Inventor(s) Roger L. Putnam, Jr., et al

It is certified that error appears in the above-identified patent and that said Letters Patent are hereby corrected as shown below:

Column 7, line 35, after "left" add --feed-- (second occurence).

Column 7, line 50, "impreforate" should be --imperforate--.

Column 7, line 58, "minimize" should be --minimized--.

Column 7, line 67, after "efficient" insert --frictional--.

Column 8, line 17, "This" should be --Thus,--.

Column 8, line 23, "driven" should be --drive--.

UNITED STATES PATENT OFFICE

CERTIFICATE OF CORRECTION

Patent No. 4,136,505 Dated January 30, 1979

Inventor(s) Roger L. Putnam, Jr., et al

It is certified that error appears in the above-identified patent and that said Letters Patent are hereby corrected as shown below:

Column 8, line 23, "clutchbrake" should be --clutch-brake--.

Column 8, line 25, "sproket" should be --sprocket--.

Column 9, line 19, after "tube" insert --of--.

Column 9, line 35, after "tube" insert --edge--.

Column 9, line 36, after "tube" insert --14--.

Column 10, line 28, "had" should be --has--.

UNITED STATES PATENT OFFICE

CERTIFICATE OF CORRECTION

Patent No. 4,136,505 Dated January 30, 1979

Inventor(s) Roger L. Putnam, Jr., et al

It is certified that error appears in the above-identified patent and that said Letters Patent are hereby corrected as shown below:

Column 10, line 33, "114" should be --144--.

Column 10, line 37, "114" should be --144--.

Column 11, line 18, "plated" should be --plates--.

Column 11, line 33, after "At" delete "the" should be --a--.

Column 12, line 4, "reciproable" should be --reciprocable--.

Column 12, line 10, after "tube" insert --of--.

UNITED STATES PATENT OFFICE

CERTIFICATE OF CORRECTION

Patent No. 4,136,505 Dated January 30, 1979

Inventor(s) Roger L. Putnam, Jr., et al

It is certified that error appears in the above-identified patent and that said Letters Patent are hereby corrected as shown below:

. Column 14, line 34, after "form" insert --,--.

Signed and Sealed this

*Seventeenth* . Day of *July 1979*

[SEAL]

*Attest:*

*Attesting Officer*

LUTRELLE F. PARKER

*Acting Commissioner of Patents and Trademarks*